US007763334B2

(12) United States Patent
Berkowitz

(10) Patent No.: US 7,763,334 B2
(45) Date of Patent: Jul. 27, 2010

(54) SYSTEM AND METHOD FOR UPGRADING BUILDING WINDOWS

(75) Inventor: Edwin J. Berkowitz, Merion Station, PA (US)

(73) Assignee: J.E. Berkowitz, L.P., Pedricktown, NJ (US)

( * ) Notice: Subject to any disclaimer, the term of this patent is extended or adjusted under 35 U.S.C. 154(b) by 679 days.

(21) Appl. No.: 11/424,624

(22) Filed: Jun. 16, 2006

(65) Prior Publication Data

US 2006/0286317 A1 Dec. 21, 2006

Related U.S. Application Data

(60) Provisional application No. 60/692,142, filed on Jun. 20, 2005.

(51) Int. Cl.
*E06B 3/00* (2006.01)
*E06B 3/64* (2006.01)
*E04C 2/54* (2006.01)

(52) U.S. Cl. ..... 428/34; 52/202; 52/204.5; 52/204.55; 52/204.6; 52/309.5; 52/786.13

(58) Field of Classification Search ..... 428/34; 52/202, 203, 204.5, 204.51, 204.55, 204.6, 52/209, 786.1, 786.13, 309.5
See application file for complete search history.

(56) References Cited

U.S. PATENT DOCUMENTS 2,177,001 A 10/1939 Owen
3,824,753 A 7/1974 Anderson
3,971,178 A 7/1976 Mazzoni et al.
4,074,480 A 2/1978 Burton
4,089,143 A 5/1978 La Pietra
4,121,394 A 10/1978 Brooks
4,194,331 A 3/1980 Gingle et al.
4,208,849 A 6/1980 Lamb
4,357,187 A 11/1982 Stanley et al.
4,494,342 A 1/1985 Decker
4,499,703 A 2/1985 Rundo
4,825,609 A * 5/1989 Rundo ..... 52/202
4,873,803 A 10/1989 Rundo
5,709,055 A * 1/1998 Levi ..... 52/204.5
5,950,398 A 9/1999 Hubbard

* cited by examiner

*Primary Examiner*—Donald Loney
(74) *Attorney, Agent, or Firm*—Rudoler & DeRosa LLC

(57) ABSTRACT

A glazing method and system for upgrading an existing single glazed window installation includes providing an insulating glass unit comprising a first glazing lite and a second glazing lite. Providing a spacer located between the existing lite and the insulating glass unit. The spacer is formed from a material which is capable of forming a seal between the insulating glass unit and the existing lite and forms a cavity between the insulating glass unit assembly and the existing glazing installation. Providing a supplemental holder for holding the insulating glass unit in place against the existing glazing installation.

11 Claims, 2 Drawing Sheets

SYSTEM AND METHOD FOR UPGRADING BUILDING WINDOWS

CROSS-REFERENCE TO RELATED APPLICATIONS

The present application claims the benefit of U.S. Provisional Application No. 60/692,142 filed on Jun. 20, 2005, which is incorporated herein by reference

STATEMENT REGARDING FEDERALLY SPONSORED RESEARCH OR DEVELOPMENT

The present invention was not developed with the use of any Federal Funds, but was developed independently by the inventor.

BACKGROUND OF THE INVENTION

Through the mid-1980s, the windows for most commercial buildings, such as offices, schools, hospitals, hotels, government buildings, residences and the like were single glazed. The use of double glazed insulating glass assemblies in such buildings generally occurred thereafter. The framing system for the single glazed assemblies was generally formed using aluminum tube. Typically, there were no thermal breaks or barriers. As a result, these buildings are not thermally efficient and have substantial heat and cooling losses through the windows. It is estimated that the area of such inefficient single glazed windows is at least two billion square feet world wide. In the United States, thousands of commercial buildings were erected during the building boom that began about thirty (30) years ago. Most of these buildings have single glazed windows.

There have been a series of approaches to correcting this problem. Probably the most costly approach is to rip out the existing glazing and replace it with insulating glass. Sometimes a new framing system is installed as well further increasing the cost of full replacements. The primary disadvantage of this approach, other than cost, is that it opens the building to the elements and prevents a tenant from occupying the space while this replacement process takes place. In addition, there is a disposal cost of the existing materials. There is also repair cost, including painting, of the existing openings. These drawbacks together with the loss of tenancy, makes such an approach an expensive operation.

There have also been attempts to create a double glazed insulating glass unit in the field using the existing outboard pane. To date these approaches have also provided unsatisfactory results. One drawback is that great exactness of size is required and the quality of the seal presents a failure issue. Further, the labor cost of manufacturing insulating glass as the field is very high.

In Europe, in the past number of years, a double glazed system has begun to find favor as a super energy saver. The system generally is installed in new buildings. Typically, the outboard lite is an insulating unit. Another single lite of glass is located some distance back into the building from the outboard lite (4"-5"), creating a flu wall effect between the lites. The air passing between the two lites is generally mechanically driven. The air inlet is from inside and the outlet is also back into the inside. The inboard lite is generally operable (hinged) so that the glass can be cleaned in the event of dirt or moisture. The system, however, is very expensive, roughly three times the price of a single glazed system. But, the comfort and energy savings are substantial and Europe's energy costs are generally higher than in the United States.

SUMMARY OF THE INVENTION

A glazing system for upgrading an existing single glazed installation comprising a double glazed insulating glass unit assembly comprising a first lite and a second lite; and a spacer located between the existing lite and the insulating glass unit.

The spacer may be formed from a non-metallic material which is capable of forming a seal between the insulating glass unit and the existing lite. In a preferred embodiment, the seal material may be a butyl material. The seal may be a tape applied at least partially around the perimeter of the existing lite.

A desiccant may be provided in the cavity, preferably as part of the spacer

A spacer seal may be provided between the insulating glass unit and the existing lite. The spacer seal may be formed from a butyl material having a desiccant.

A supplemental holder may be provided for holding the insulating glass unit in place against the existing single glazed installation. The holder may be a compression angle and may also include a fastener, such as a screw, for securing the compression angle in place.

A pressure relief device may be provided for venting the cavity.

A setting block located between the insulating glass unit and the sill for supporting the insulating glass unit may also be provided.

Various other features and attendant advantages of the present invention will become more fully appreciated and better understood when considered in conjunction with the accompanying figures.

BRIEF DESCRIPTION OF THE SEVERAL VIEWS OF THE DRAWINGS

The invention is best understood from the following detailed description when read together with the accompanying drawings.

DESCRIPTION OF THE PREFERRED INVENTION

The invention relates to a method and system for applying a factory manufactured double glazed insulating glass unit to an existing single glazed window assembly by placing the insulating glass unit on the inside of the existing glass. This system also helps to reduce the cold edge effect of a non-thermally broken glazing system and gives approximately the performance of a triple glazed unit, which is far superior to that of a double glazed unit or single glazed unit. As used herein, the term lite refers to a glass sheet. A single glazed unit or assembly is a window assembly with a single lite. A double glazed insulating glass unit or assembly (sometimes referred to more simply as an insulating glass unit or assembly) refers to a window assembly with two lites, separated by some space, along with the frame and associate mechanical hardware holding the lites.

Figure 1:
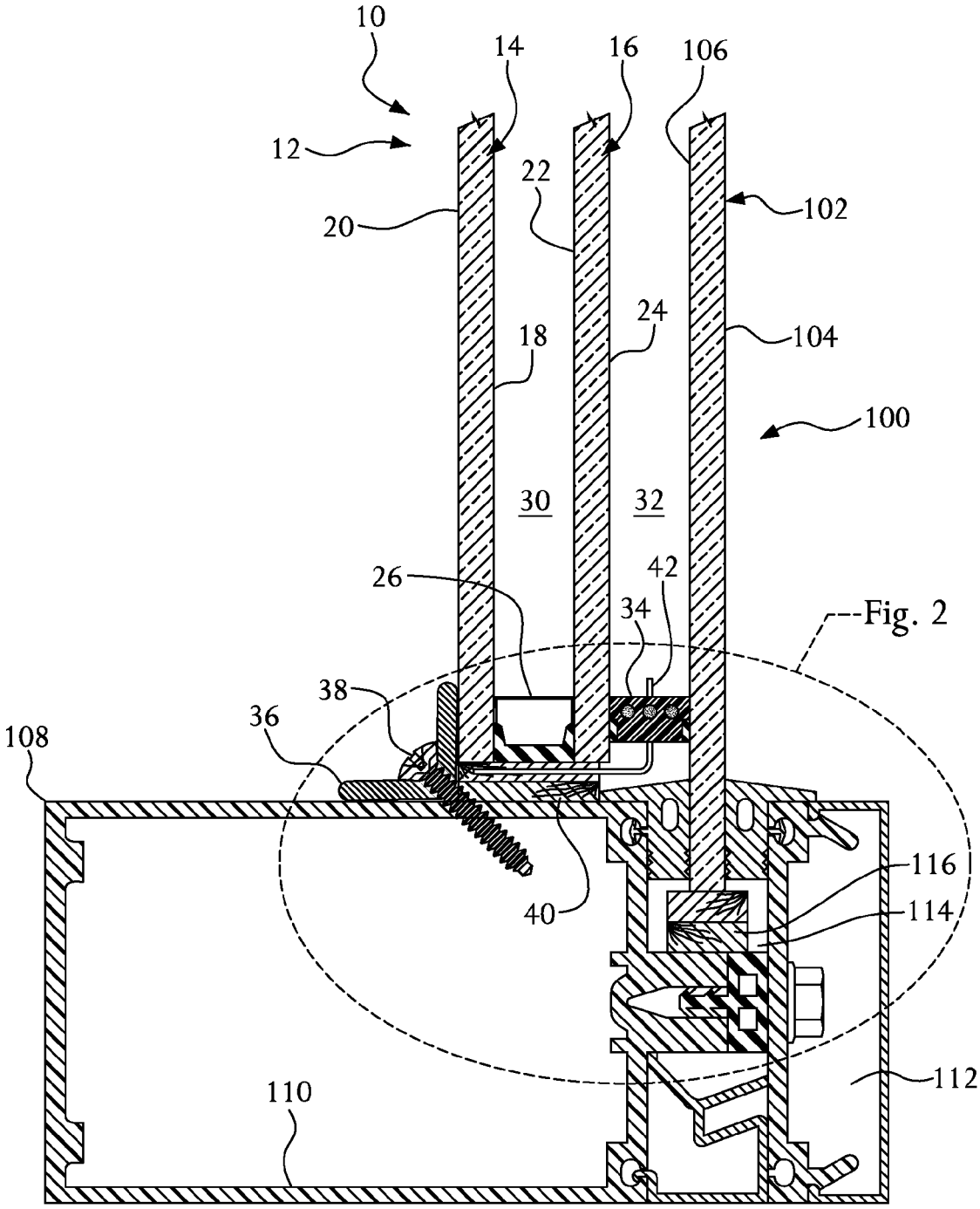
FIG. 1 depicts a cross-sectional view of the glazing system of the present invention mounted on a typical single glazed window.

In FIG. 1 there is shown the glazing system 10 of the current invention mounted on a typical single glazed window unit 100. The existing single glazed window unit 100 comprises a lite 102 having outer surface 104 and inner surface 106. The lite 102 is mounted into an existing window sill 108 having an inner portion 110 attached to an outer portion 112. A channel 114 is formed between the inner 110 and outer 112 portions. The lite 102 is received in the channel 114 and rests on a setting block 116. The sill is typically fabricated from an aluminum material; however, other materials are also in common use. Typically, a glazing bead is located on both sides of the pane 102 for sealing the pane 102 in the channel 114. It should be noted that the existing singled glazed window assembly, sill and associated mounting hardware shown in FIG. 1 (and indicated with reference numbers 100-116) are exemplary only and are not intended to limit the scope of the invention in any way. Indeed the invention may readily be used with a wide variety of single glazed window configurations.

The glazing system 10 comprises an insulating glass unit or window assembly 12 comprised of a first lite 14 and a second lite 16. The first lite 14 has opposing faces 18 and 20 and second lite 16 has opposing faces 22 and 24.

Typically, the insulating glass unit 12 also includes a spacer seal 26 located between the panes 14 and 16. Typically the insulating glass unit 12 is pre-fabricated at a factory or manufacturing facility.

The insulating glass unit 12 preferably includes a low emissivity coating, usually on face 22. Further enhancements are possible, such as providing a thermal insulating gas filling in cavity 30, body tint glass, tempered glass, laminated glass, and the like.

The principal difficulty in preparing a field installation for an insulating glass unit 12 is in creating a seal between the existing window unit 100 and the insulating glass unit 12 that is air tight and will not leak over time. If outside air or moisture leak into the space 32 between the new insulating glass unit 12 and the existing window unit 100, it can cause fogging of the lite 102 when the outside temperature drops substantially below the room temperature. Such fogging is aesthetically undesirable, and the insulating glass unit 12 may need to be removed and cleaned.

In FIG. 1 there is shown a spacer seal 34 located between the existing pane 102 and the second pane 16. In the preferred embodiment the spacer seal 34 is a non-metal spacer that incorporates a polyisobutyline seal. It should be understood that other spacer materials and sealing materials can be substituted as long as the possess suitable sealing properties and can function as a suitable spacer.

In a preferred embodiment, the spacer seal 34 also preferably incorporates a desiccant which acts as a drying agent to absorb any moisture trapped in the air space 32 between the insulating glass unit 12 and the existing lite 102. The space may contain stiff foam, rubber, a shim made of metal, other suitable material or a combination of materials. The spacer is ideally stiff enough to provide separation between the existing lite 102 and the forward lite 16 of the insulating glass unit 12 yet pliable enough to provide an air tight seal between surfaces 24 and 106. Preferably the spacer includes an adhesive on both sides to mechanically couple and seal the two lites 16, 102. Thus, in the preferred embodiment, the spacer acts as both a spacer and seal. The spacer seal 34 may be in the form of a tape, as shown in FIG. 1, that can be applied approximately around the perimeter of the existing lite 102. Such tapes are currently commercially available from a number of manufacturers and are also used in factory production of double glazed glass units. The invention is not meant to be limited to sealants of any particular type and any suitable sealant may be used.

Figure 2:
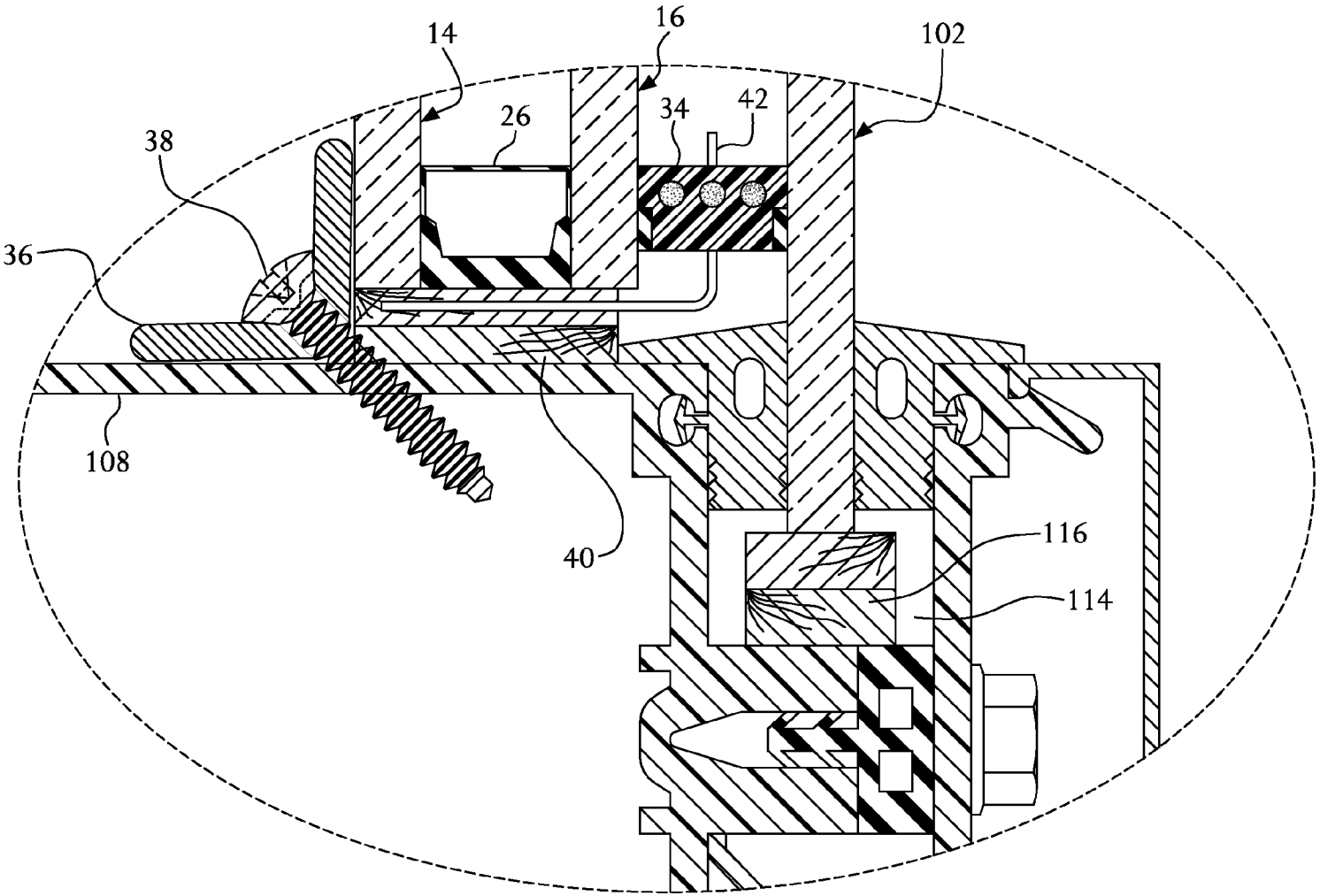
FIG. 2 depicts a cross-sectional view of a preferred compression angle for use with the glazing system shown in FIG. 1.

A cove molding or compression angle 36 is added around the inside perimeter of the insulating glass unit 12 to mechanically hold the insulating glass unit 12 in place against the sill 108 and the existing lite 102. The compression angle 36 is shaped so that a fastener 38, such as a compressing screw 12 can be used to fasten the compression angle 36 to the sill 108 to hold the window unit 12 in place. If a screw is used, the screw may be screwed in at an approximate 45 degree angle into the existing sill 108, although other angles may be suitable. This causes the force of the screw to create two vectors, one pushing against the sill 108 holding the window assembly tightly in place and the second vector pushing against the existing lite 104 which compresses the spacer seal 34. The compression angle 36 may be used on some or all of the edges of the insulating glass unit 12. One suitable compression angle 36 is shown in FIG. 2. The compression angle provides a supplemental holding mechanism to secure the insulating glass unit 12 in place in addition to the adhesively mounted spacer seal 34.

Preferably, the factory double glazed insulating glass unit 12 is slightly smaller than the existing building window 102 so that it can be slipped into place without coming into contact with (or having minimal contact with) the existing metal window frame due to the presence of the non-thermally conducting setting blocks 40. This avoids the need for precise sizing of the insulating glass unit 12 and reduces the transfer of heat through the existing window frame. It also allows for movement in the window frame. The difference in size between the insulating glass unit 12 and pane 102 is covered by the compression angle 36.

In one preferred embodiment, a pressure relief device 42 or vent, such as a tube or valve, is installed in the cavity 32 between the existing lite 102 and the insulating glass unit 12. One end of the relief device 42 vents the cavity 32 to the other side of the insulating glass unit 12. Placement of the vent 42 is shown in the middle of the cavity 32; however, it should be understood that the placement can be anywhere in the cavity including against lite 106 or lite 16. The routing of the vent 42 may be accomplished in many ways and need not run through the setting block 40. During and after preferably installation the air can be evacuated through the tube. This avoids the compression of the air in the space 32 between the insulating glass unit 12 and existing window pane 102 when the glazing system 10 is first installed. Further, when the air in the space 32 expands due to heat from direct sun light and/or outside temperatures the pressure relief device may provide pressure equalization that helps to preserve the seal. Seal failure may be accelerated by expansion of trapped air during periods of sunshine and high temperature. The pressure relief devices may eliminate this pressure build up by balancing of trapped air with the inside room air pressure. In one embodiment air in cavity 32 is evacuated after installation of the insulating glass unit 12 and then vent 42 is permanently sealed. In a preferred embodiment the vent continues to allow air to push out of cavity 32 throughout the life of the glazing system 10.

To provide further mechanical support for the seal 34 between the existing glass and the window assembly a structural silicon clip (not shown) may be provided at various points along the perimeter of the unit between the surfaces 24 and 106. The silicon acts as an adhesive, holding the new unit to the existing window and provides a backup to the mechanical force provided by the molding, thereby reducing stress on the seal. The silicon clips may be distributed as required. In one embodiment they are placed along each edge at the quarter, half-way, and three-quarters points, in parallel to the spacer seal. Industrial adhesives, such as silicon, acrylic, and the like, may be used to provide this additional mechanical support. Other suitable adhesives are also contemplated having similar material, mechanical and thermal properties.

The result of the above is an in-place working triple insulating glass unit with superior thermal properties which is provided at a cost substantially less than that of replacing the entire metal and glass system. It is also superior in thermal performance to that of simply replacing the glass with a double glazed unit.

The benefits may include saving over half the energy lost through a single glazed window. This results in lower demand on the HVAC system. Therefore, a longer life and less maintenance can be expected. In case of replacement of the HVAC system, lesser capacity may be required. Further, a more comfortable and even interior climate results particularly in the area adjoining the windows. In effect, this allows greater usable space for the tenant, which permits additional rent.

Further benefits include a sound-deadening effect that reduces exterior noise. Depending on the installation, sound reduction of 8 to 10 decibels may occur, which is in the range of 40% noise reduction.

The resulting triple glazed unit affords increased security as it would require the penetration of all three panes of glass in order to enter the interior space. Where security is a consideration, the use of tempered glass or laminated glass in the factory-manufactured unit is a further enhancement.

Since the factory made insulating glass unit is not attached directly to the framing system of the existing window, transfer of cold through the aluminum framing of the existing unit (the "cold edge" effect) is greatly reduced. Likewise, the present invention also avoids the precise fitting of the insulating glass unit to the opening and it allows for expansion and contraction without damage to the insulating unit, which is preferably slightly undersized.

The benefits described above are not necessary to the invention, are provided by way of demonstration and are not intended to in any way limit the invention.

What is claimed is:

1. A field installable glazing system for upgrading an existing glazing installation which comprises an existing window lite and sill, said glazing system comprising:

an insulating glass unit comprising a first lite and a second lite; and an integrated spacer seal located between the existing lite and the insulating glass unit; and a fastener for mechanically securing the insulating glass unit in place;

wherein the spacer seal is a tape further comprised of polyisobutyline, foam, desiccant and adhesive, said tape contacting only one side of the insulating glass unit.

2. The glazing system according to claim 1, wherein the tape is applied around the perimeter of the existing lite.

3. The glazing system according to claim 1, wherein the adhesive is on two exterior surfaces of the tape.

4. The glazing system according to claim 1, wherein the insulating glass unit is further comprised of a spacer seal between the first and second lites.

5. The glazing system according to claim 1, wherein the fastener applies a force against the sill for holding the window assembly in place and another force towards the existing window lite for compressing the spacer seal.

6. The glazing system according to claim 1, wherein the insulating glass unit is a pre-assembled assembly.

7. The glazing system of claim 1 wherein the polyisobutyline is on two exterior surfaces of the tape.

8. The glazing system of claim 1 wherein the desiccant is embedded within the foam.

9. The glazing system of claim 1 wherein one of the insulating glass unit includes a low emissivity coating on one of the lite surfaces.

10. A field installable glazing system for upgrading an existing glazing installation which comprises an existing window lite and sill, comprising:

an insulating glass unit comprising a first glazing lite and a second glazing lite and a first spacer located between the first and second lites;

a second spacer seal located between the existing lite and the insulating glass unit forming a seal between the insulating glass unit and the existing lite and forming a cavity between the insulating glass unit and the existing glazing installation; and a fastener for mechanically holding the insulating glass unit in place against the existing glazing installation, the fastener applies a force against the sill for holding the insulating glass unit in place and another force towards the existing window lite for compressing the second spacer;

wherein the second spacer seal is a tape is a tape further comprised of polyisobutyline, foam, desiccant and adhesive, said tape contacting only one side of the insulating glass unit.

11. The glazing system according to claim 10, wherein the insulating glass unit is a pre-assembled assembly.

* * * * *